US005632536A

United States Patent [19]

Kitamura

[11] Patent Number: 5,632,536

[45] Date of Patent: May 27, 1997

[54] DOUBLE LOCK TYPE ELECTRICAL CONNECTOR

[75] Inventor: Hiroshi Kitamura, Kawasaki, Japan

[73] Assignee: The Whitaker Corporation, Wilmington, Del.

[21] Appl. No.: 304,964

[22] Filed: Sep. 13, 1994

[30] Foreign Application Priority Data

Nov. 15, 1993 [JP] Japan ..... 5-061234

[51] Int. Cl.[6] ..... H01R 13/514

[52] U.S. Cl. ..... 439/752; 439/595

[58] Field of Search ..... 439/752, 595

[56] References Cited

U.S. PATENT DOCUMENTS 4,752,251 6/1988 Kato et al. ..... 439/752 OR
5,167,534 12/1992 Ohsumi ..... 439/595 OR
5,299,958 4/1994 Ohsumi ..... 439/752 OR
5,411,421 5/1995 McCardell, Jr. ..... 439/752 AR

FOREIGN PATENT DOCUMENTS 8960474 4/1989 Japan .
9123440 3/1993 Japan .

*Primary Examiner*—P. Austin Bradley
*Assistant Examiner*—Daniel Wittels

[57] ABSTRACT

A plastic double-lock member (40) with guide grooves (44) extending in a mating direction for guiding ribs in a matable connector. Integral end walls (48) are formed to close inner walls of the guide grooves (44) at end portions of the guide grooves (44). The end walls (48) are formed with latching lances (50) to engage with an insulating housing (20). The provision of the end walls (48) minimizes the non-uniformity of cooling of the plastic material which comprises the double-lock member (40), thereby reducing undesirable deformation of the double-lock member (40) caused during contraction of the plastic material after molding.

14 Claims, 4 Drawing Sheets

DOUBLE LOCK TYPE ELECTRICAL CONNECTOR

FIELD OF INVENTION

The present invention relates to a double-lock electrical connector comprising an insulating housing having contact receiving cavities and a double-lock member installed in the insulating housing for retaining contacts by locking members in contact receiving cavities and the double-lock member.

BACKGROUND OF THE ART

A conventional double-lock electrical connector comprises an insulating housing having a plurality of contact receiving cavities defined by isolation walls and a double-lock member to be mounted on the insulating housing in perpendicular relationship to the longitudinal direction of the contact receiving cavities. The double-lock member has contact insertion openings corresponding to the contact receiving cavities in the insulating housing. In such a double-lock electrical connector, the double-lock member is brought into a preliminary locking position relative to the insulating housing before being moved to a final locking position. In this manner, each contact is locked by a locking member within the respective contact receiving cavity as well as by the double-locking member, thereby achieving double locking of the contact for assured retention.

In a double-lock electrical connector, a housing of a matable connector may not always mate straightly. That is, the matable connector tends to mate in a slanted manner, thereby making the mating operation difficult or time consuming. In order to overcome this problem, there is proposed a double-lock electrical connector having an insulating housing and a double-lock member formed with guide grooves for guiding ribs on the housing of a matable connector, thereby achieving smooth mating of the matable connector.

Unfortunately, however, the double-lock member is typically made from plastic material by injection molding. Thinned portions of the molded double-lock member's guide grooves are cooled faster than the other portions of the double-lock member. Thus non-uniform cooling of the double-lock member exists. On the other hand, if designed to achieve uniform cooling for minimizing deformation, no guide grooves can be formed.

It is, therefore, an object of the present invention to provide a double-lock electrical connector provided with a double-lock member for improved mating operation and minimum deformation.

SUMMARY OF THE INVENTION

In order to achieve the above object, the double-lock electrical connector according to the present invention has a housing provided with first guide grooves extending in the mating direction to guide a matable connector housing and a double-lock member insertion cavity in perpendicular relation relative to the mating direction. The insertion cavity is formed behind a double-lock member insertion mouth in communication with the first grooves. Also, the double-lock member has second guide grooves in communication with the first guide grooves when installed in the housing for guiding the matable connector housing. The improvement resides in that the double-lock member is provided with end walls that in continuous with the sidewalls of the second guide grooves at the end portions thereof and engaging portions on the end walls to engage with the housing.

The double-lock electrical connector according the present invention is provided with first and second guide grooves to guide a matable connector housing, thereby allowing smooth mating with such matable connector and improving the mating operation. Additionally, the end walls are continuously formed with the sidewalls of the second guide grooves which help to achieve a more uniform cooling of the molded connector as compared with the conventional design, thereby minimizing deformation because of more uniform contraction during cooling.

Now, the double-lock electrical connector according to the present invention will be described hereunder in detail with reference to the accompanying drawings illustrating one embodiment thereof.

DETAILED DESCRIPTION OF THE INVENTION

Figure 1:
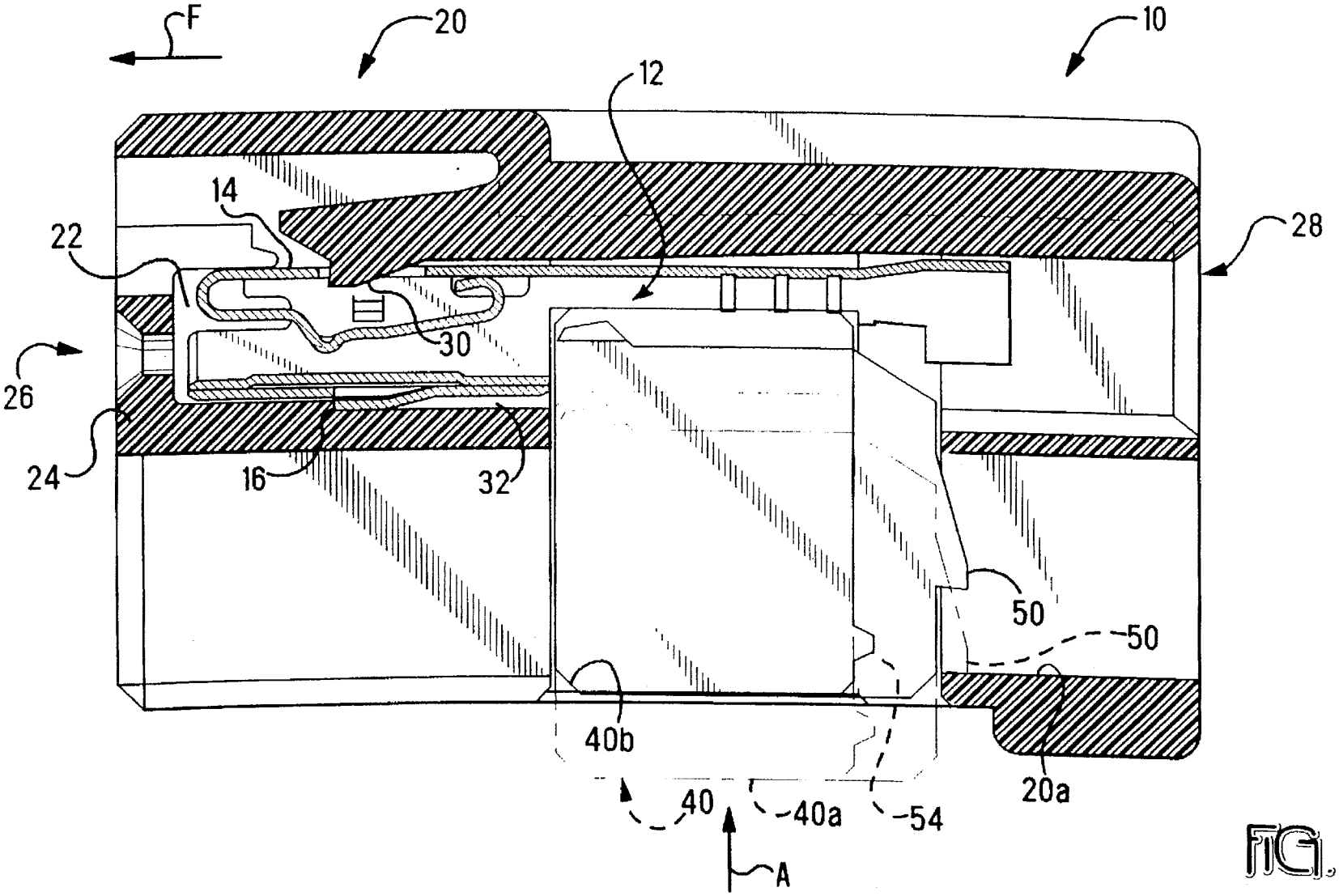
FIG. 1 is a cross sectional view of one embodiment of the double-lock electrical connector according to the present invention.
Figure 2:
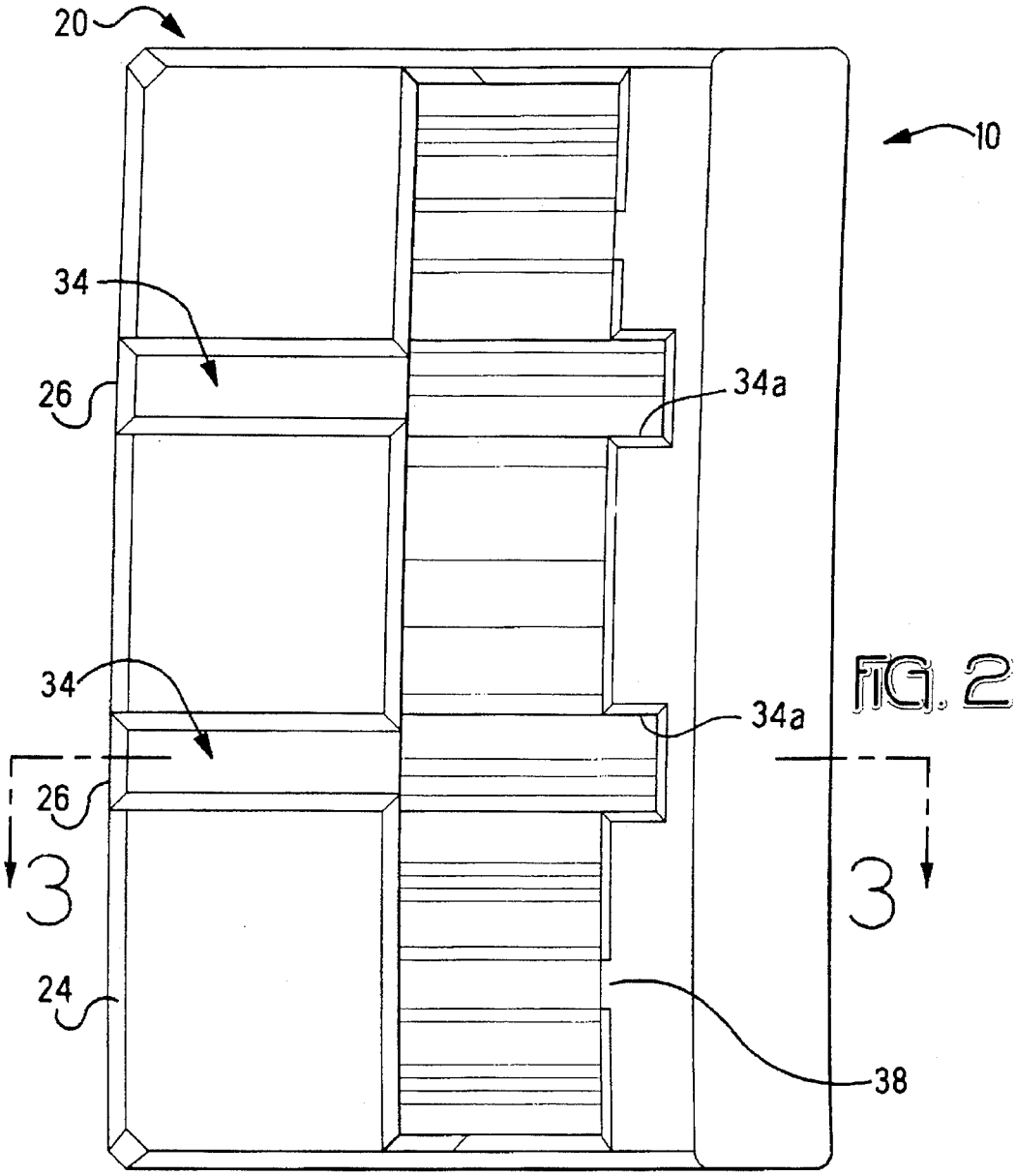
FIG. 2 is a bottom view of the insulating housing of the double-lock electrical connector in FIG. 1 as seen from the direction of the arrow A.
Figure 3:
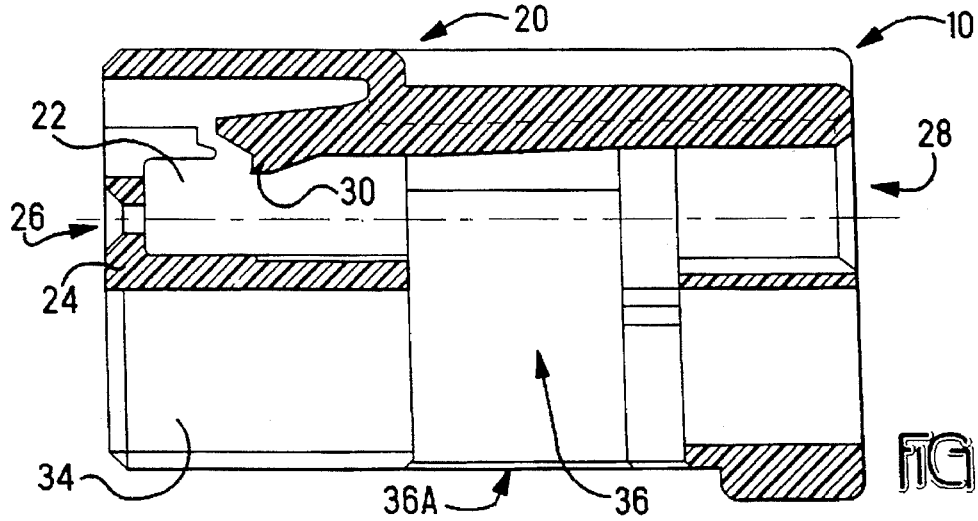
FIG. 3 is a cross sectional view of the insulating housing in FIG. 2 along the line 3—3.
Figure 4:
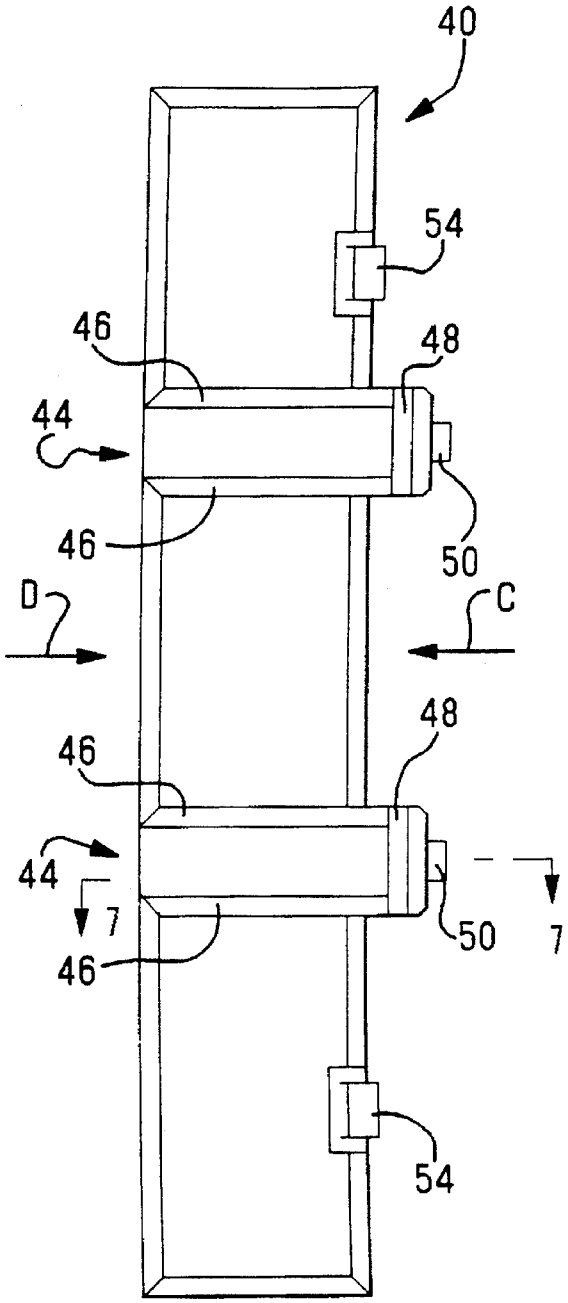
FIG. 4 is a bottom view of the double-lock member of the double-lock electrical connector in FIG. 1 as seen from the direction of the arrow A.
Figure 5:
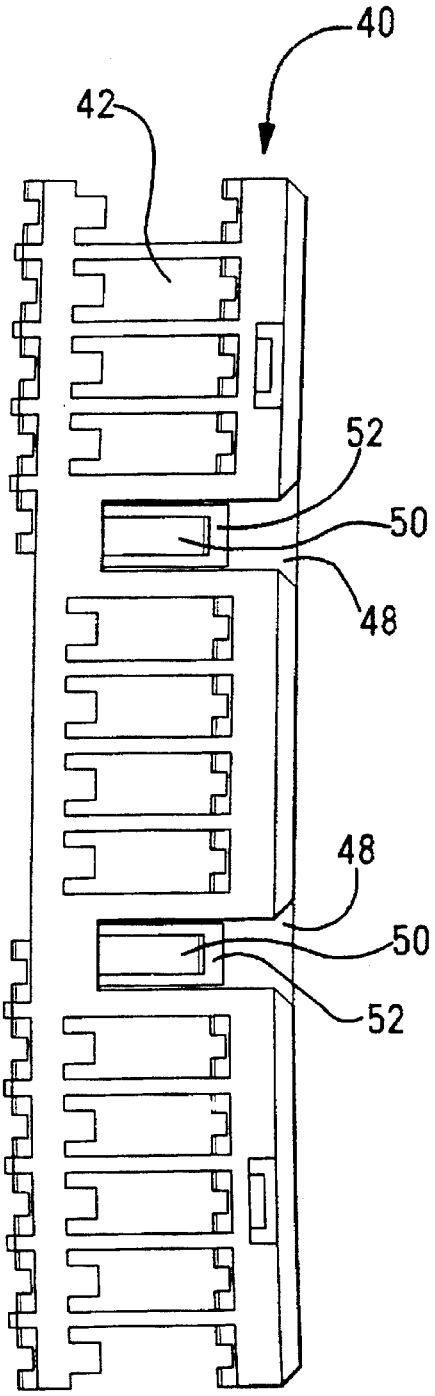
FIG. 5 is the double-lock member in FIG. 4 as seen from the direction of the arrow D.
Figure 6:
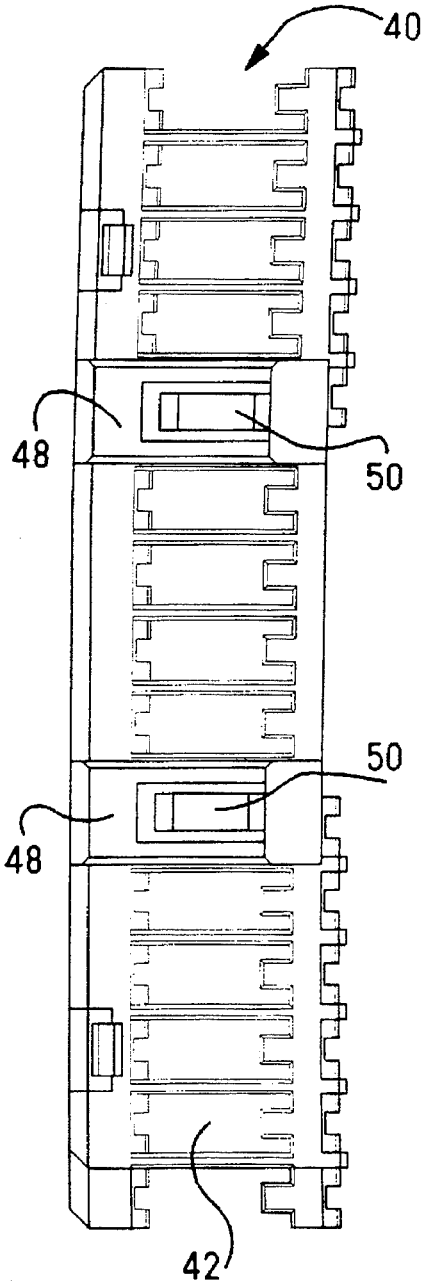
FIG. 6 is the double-lock member in FIG. 4 as seen from the direction of the arrow C.
Figure 7:
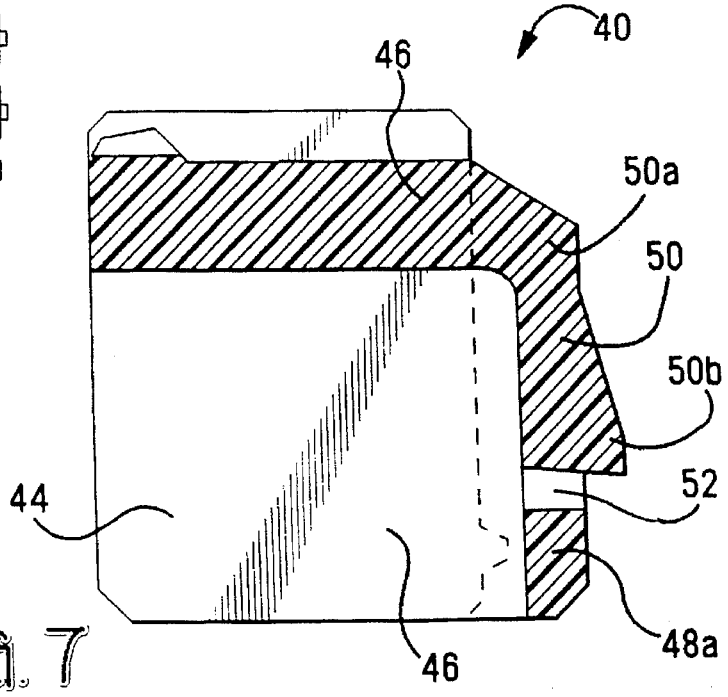
FIG. 7 is a cross sectional view of the double-lock member along the line 7—7 of FIG. 4.

A double-lock electrical connector 10 as illustrated in FIG. 1 is a male type connector containing a plurality of female (receptacle) contacts 12 and comprises an insulating housing 20 and a double-lock member 40. The double-lock electrical connector 10 is designed to mate with a matable female connector (not shown) having a plurality of male contacts by moving it in the mating direction (represented by F), thereby making electrical connection or engagement between the male contacts in the female connector and female contacts 12 in the double-lock electrical connector 10.

The insulating housing 20 is formed with a plurality of contact receiving cavities 22. A male contact insertion passage 26 is formed in each contact receiving cavity 22 in communication therewith in a wall 24 at the front end portion in the mating direction. On the other hand, an opening 28 is formed at the rear end portion in the mating direction for insertion of each female contact 12. The top wall in each contact receiving cavity 22 is formed with an engaging projection 30 projecting inwardly. Also, the bottom wall is formed with an engaging recess 32 at the location corresponding to the engaging projection 30. In mating with the matable female connector (not shown), ribs (not shown) are formed in the housing of the female connector for guiding it, thereby allowing smooth mating of both connectors in the mating direction along the two guide grooves 34. Also, a double-lock member insertion mouth 36*a* is formed at the center portion of the insulating housing 20 in communication with the two guide grooves 34 for inserting the double-lock member 40 into the double-lock member receiving cavity 36.

At the front end portion of the contact 12 received in the contact receiving cavity 22, there is formed a contact engaging (or locking) portion 14 to engage with the engaging projection 30 for protecting the backing out of the contact. A contact engaging portion 16 engages the engaging recess 32 for protecting forward removal of the contact.

The double-lock member 40 is formed with contact insertion openings 42 in corresponding relation to the contact receiving cavities 22. When the double-lock member 40 is latched to a preliminary locking position (the position represented by the double-chain line 40*a* in FIG. 1) of the insulating housing 20, the female contacts 12 are inserted into the contact receiving cavities 22. Subsequently, the double-lock member 40 is latched to a preliminary locking position (the position represented by the double-chain line 40*a* in FIG. 1). Also, the double-lock member 40 is formed with guide grooves 44 at the locations corresponding to the two guide grooves 34 in the insulating housing 20, thereby guiding the ribs on the housing of the female connector received in the guide grooves 34 when the double-lock member 40 is locked into the final locking position. As a result, the double-lock electrical connector 10 and the female connector mate smoothly with each other to improve their mating operation.

It is to be noted that end walls 48 are formed at the end portions of the guide grooves in the double-lock member 40 in continuation with the sidewalls 46 of the guide grooves 44. Cantilever lances (engaging portions) 50 comprising base ends 50*a* and free ends 50*b* are formed on the end walls 48 to define slots 52 between the other ends 50*b* and the walls 48*a*. As the double-lock member 40 is inserted into the double-lock member receiving cavity 36 through the double-lock member insertion mouth 36*a*, the lances 50 are deflected but recover to their original (non-deflected) position when the double-lock member 40 is inserted to the preliminary locking position, thereby locking it to the wall 20*a* of the insulating housing 20. The double-lock member 40 is, then, prevented from backing out of this position. When the double-lock member 40 is moved to its final locking position, the projections 54 are latched to the engaging portions 38 in the insulating housing 20.

The double-lock member 40 is made from a plastic material by injection molding. However, it is found that the provision of the end walls 48 in continuation with the sidewalls 46 of the guide grooves 44 assures more uniform cooling as compared with the conventional double-lock member. Additionally, the lances 50 formed on the end walls 48 provide reliable locking or retention of the double-lock member 40 in the insulating housing 20.

As apparent from the foregoing description, the double-lock member of the double-lock electrical connector features the provision of the end walls in continuation with the sidewalls of the second guide grooves, thereby achieving more uniform cooling of the molded double-lock member and minimizing deformation as compared with the conventional double-lock member.

I claim:

1. A male electrical connector half for mating with a complimentary female electrical connector half, said male connector half comprising:

an insulating housing having a plurality of contact insertion passages for receiving electrical contacts therein, and said insulating housing includes a double-lock member receiving cavity, said cavity is formed in a first exterior surface of the male connector half;

a plastic double-lock member having contact insertion openings for alignment with the contact insertion passages, said double-lock member is shaped to fit into the double-lock member receiving cavity for locking said electrical contacts in said housing; and said double lock member further includes at least one guide groove formed in a second exterior surface adjacent said first exterior surface, said double-lock member having at least one end wall and at least one latching member for latching said double lock member into said housing.

2. The male electrical connector half of claim 1, wherein said end wall is formed adjacent to said guide groove as a continuation of the guide groove.

3. The male electrical connector half of claim 2, wherein said end wall includes a deflectable lance for latching said double-lock member to said insulating housing.

4. The male electrical connector half of claim 1, wherein said guide groove extends substantially across the double-lock member.

5. The male electrical connector half of claim 4, wherein said end wall includes a gap in communication with said guide groove.

6. The male electrical connector half of claim 5, wherein a cantilever lance is formed on said end wall for latching said double-lock member in said insulating housing.

7. The male electrical connector half of claim 1, wherein a lance is formed on said end wall, which lance comprises a free end defining a gap in said end wall.

8. The male electrical connector half of claim 7, wherein said lance is resiliently deflectable.

9. An electrical connector for mating with a complementary connector comprising:

an insulating housing having a plurality of contact passageways for receiving electrical contacts, a double-lock receiving cavity disposed in communication with said passageways having at least one double-lock guide groove, and at least one mating guide groove disposed on a surface of the housing perpendicular to said double-lock guide groove, and a double-lock member for insertion into said double lock receiving cavity having contact insertion openings for alignment with the contact receiving passageways, at least one latching member located at an end of a secondary guide groove which cooperates with said double-lock guide groove in the housing and latches said double-lock member to the housing in a position permitting insertion of the electrical contacts into the contact passageways, said secondary guide groove disposed on a major surface of said double-lock member which is aligned with said mating guide groove in the housing when said double-lock member is in a fully inserted position, and at least one projection on said double-lock member for maintaining said double-lock member in the housing in the fully inserted position so that the mating guide groove and the secondary guide groove are aligned to receive a rib on the complementary connector.

10. The electrical connector recited in claim 9 wherein said latching member comprises a cantilever latching arm.

11. The electrical connector recited in claim 9 wherein said at least one projection on the double-lock member engages at least one engaging portion on the housing.

12. The electrical connector recited in claim 9 wherein at least two mating guide grooves are disposed on a bottom surface of the housing and in perpendicular alignment with at least two double lock guide grooves which extend along a wall of said double lock cavity.

13. The electrical connector of claim 9 wherein said secondary guide groove in said double-lock member is generally U-shaped having two side walls and a base wall, said latching member being disposed on the base wall of the U-shaped groove.

14. The electrical connector of claim 9 wherein said latching member and said projection on said double lock member are spaced both transversely and laterally from each other.

* * * * *